US006253789B1

(12) United States Patent
Krimmer et al.

(10) Patent No.: US 6,253,789 B1
(45) Date of Patent: Jul. 3, 2001

(54) VALVE FOR METERED INTRODUCTION OF VOLATILIZED FUEL

(75) Inventors: Erwin Krimmer, Pluederhausen; Wolfgang Schulz, Bietigheim-Bissingen; Tilman Miehle, Kernen; Manfred Zimmermann, Bad Rappenau; Maria Esperilla, Meimsheim, all of (DE)

(73) Assignee: Robert Bosch GmbH, Stuggart (DE)

( * ) Notice: Subject to any disclaimer, the term of this patent is extended or adjusted under 35 U.S.C. 154(b) by 0 days.

(21) Appl. No.: 09/530,417

(22) PCT Filed: Apr. 13, 1999

(86) PCT No.: PCT/DE99/01104

§ 371 Date: Jun. 5, 2000

§ 102(e) Date: Jun. 5, 2000

(87) PCT Pub. No.: WO00/12889

PCT Pub. Date: Mar. 9, 2000

(30) Foreign Application Priority Data

Aug. 29, 1998 (DE) ..... 198 39 476

(51) Int. Cl.[7] ..... F02M 33/04
(52) U.S. Cl. ..... 137/550; 251/129.21; 123/516
(58) Field of Search ..... 137/550; 251/129.21, 251/367, 129.22; 123/516, 458

(56) References Cited

U.S. PATENT DOCUMENTS 4,254,938 * 3/1981 Inada et al. ..... 251/367
4,582,085 * 4/1986 Hafner et al. ..... 239/585.3
5,076,323 * 12/1991 Schudt ..... 137/596.17
5,178,116 * 1/1993 Fehrenbach et al. ..... 123/520
5,560,585 * 10/1996 Krimmer et al. ..... 251/129.21
5,809,977 * 9/1998 Krimmer et al. ..... 123/516
6,149,126 * 11/2000 Krimmer et al. ..... 251/129.21

* cited by examiner

*Primary Examiner*—A. Michael Chambers
(74) *Attorney, Agent, or Firm*—Ronald E. Greigg; Edwin E. Greigg

(57) ABSTRACT

A valve for metered introduction of fuel, volatilized from a fuel tank of an internal combustion engine, into the engine, having a valve housing which has an inflow neck for connection to a fuel tank or to an adsorption filter downstream of the tank for the volatilized fuel, and having an outflow neck for connection to the engine, having a valve member accommodated between the inflow neck and the outflow neck in the interior of the valve housing, which valve member is actuatable by an electromagnet that has a magnet core, and which cooperates with a valve seat embodied on a valve seat body, is characterized in that the valve housing includes a first housing part, closed on the inflow side by a protective screen, in/on which the electromagnet, the valve member, the valve seat body and the outflow neck are provided, and a second housing part, on which the inflow neck is disposed and which can be secured to the first housing part.

16 Claims, 2 Drawing Sheets

VALVE FOR METERED INTRODUCTION OF VOLATILIZED FUEL

PRIOR ART

The invention relates to a valve for the metered introduction of fuel into an internal combustion engine in which the fuel is volatilized from a fuel tank.

One such valve is disclosed for instance by German Patent Application DE 195 33 742 A1, and by German Patent Application DE 197 21 562.9, which had not been published by the priority date of the present application.

These valves are used to regenerate adsorption filters for fuel vapor trapping systems of the fuel tank of motor vehicles. Since such adsorption filters contain activated charcoal particles, soiling of the valve can occur in scavenging processes, as a result of activated charcoal particles that have been torn loose and aspirated.

In known valves, protective screens, protective filters and the like can sometimes be employed only at very great effort, because of the particular design in question.

An object of the invention is to refine a valve of the generic type as defined above such that while being highly versatile in terms of its connectors and holders, the value is as invulnerable to dirt as possible and allows high maximum scavenging quantities.

In a valve for metered introduction of volatilized fuel of the type defined at the outset, this object is attained according to the invention as set forth hereinafter.

Because of the two-part embodiment: of the valve housing, the modularity of the valve is increased, and producing the value is made considerably simpler. Because of this two-part embodiment, it is possible to postpone producing such type-specific differences as holders, connectors and the like, until the end of valve production, by securing the second part. It is also highly advantageous that the first part is closed on the inflow side by a protective screen. This prevents soiling of the valve, and the protective screen can occupy the entire end face on the inflow side of the first housing part.

In an advantageous embodiment, it is provided that the two housing parts are separably joined together. This exemplary embodiment has the great advantage in particular that if the protective screen becomes stopped up, for instance, it is easily possible to open the housing and replace the protective screen.

The connection can preferably be embodied by a bayonet connection. It is understood that other separable connections can also be considered.

In another embodiment, it is provided that the two housing parts are inseparably joined together.

Both to make an inseparable connection and to make a separable connection, a detent connection can advantageously be employed. In the case of an inseparable detent connection, the detent elements are designed such that the detents are destroyed upon separation. Conversely, a separable detent connection can be undone with a suitable tool.

With regard to the disposition and securing of the protective screen, once again the most various embodiments are possible. One embodiment provides that the protective screen is inseparably welded to the first housing part.

Another embodiment provides that the protective screen is separably secured to the first housing part. This embodiment offers the advantage in particular of easy replaceability of the protective screen.

BRIEF DESCRIPTION OF THE DRAWING

Further advantages and characteristics of the invention are the subject of the ensuing description and the illustration of an exemplary embodiment in the drawing.

Shown in the drawing are.

DESCRIPTION OF THE EXEMPLARY EMBODIMENTS

Figure 2:
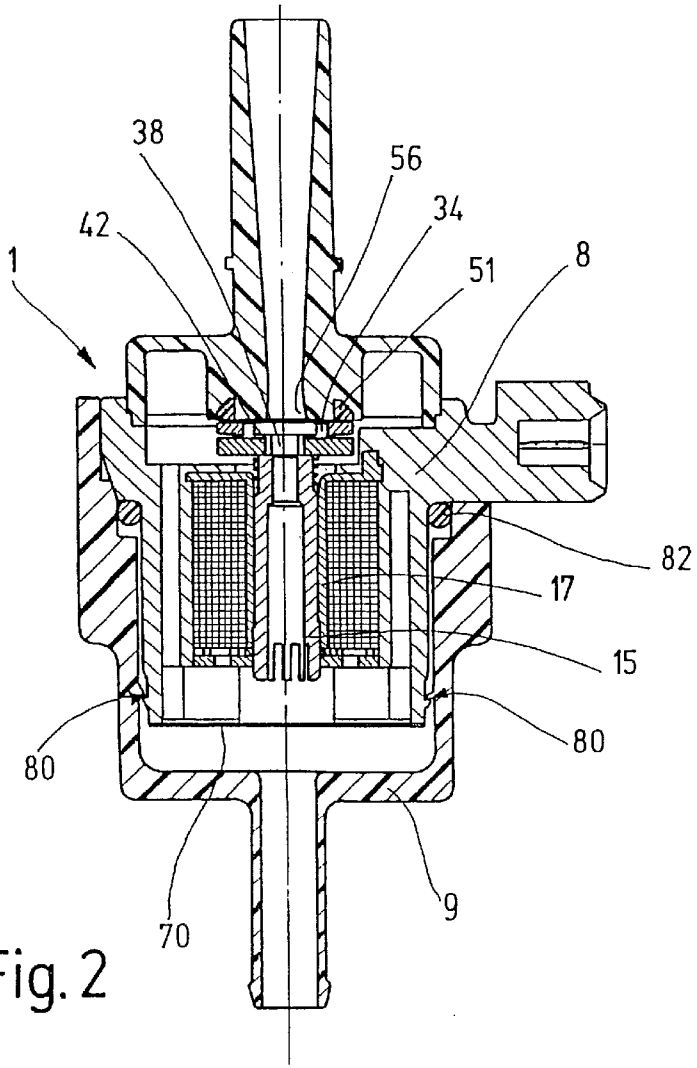
FIG. 2 is a section taken along the line I—I of FIG. 1.
Figure 1:
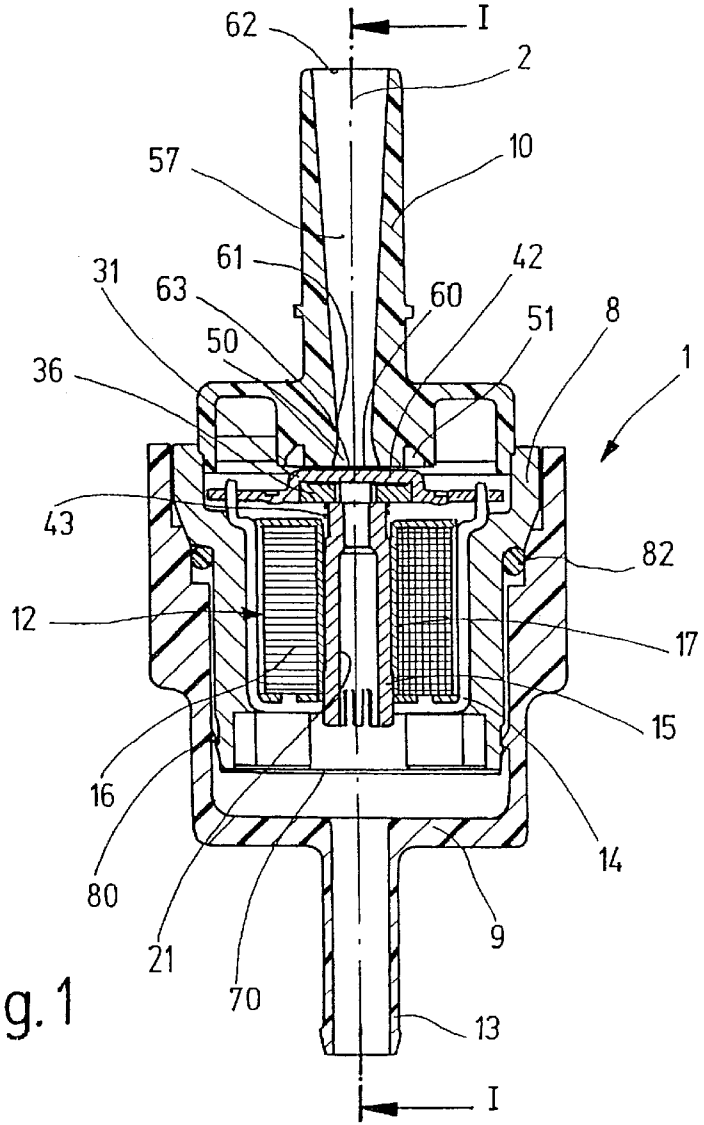
FIG. 1 schematically illustrates a longitudinal section through a valve according to the invention.

The valve 1 shown in FIG. 1 and FIG. 2 in longitudinal sectional views is used for the metered introduction of volatilized fuel, from a fuel tank of an internal combustion engine (not shown), into an intake tube of an engine, directly into a cylinder of the engine, and the value is part of a fuel vapor trapping system, not shown in further detail, of a mixture-compressing internal combustion engine with externally supplied ignition. The design and function of such fuel vapor trapping systems can be learned for instance from Bosch Technische Unterrichtung Motormanagement Motronic [Bosch Technical Instruction, Motronic Motor Management], 2nd Edition, August 1993, pp. 48 and 49. The design and mode of operation of a valve 1, also known as a regeneration valve or tank venting valve, is known from German Patent Application DE 195 33 742 A1, and in particular from DE 197, 21, 562.9, which are hereby incorporated by reference into the present patent application.

Coaxially to a valve longitudinal axis 2, the valve has a two-part valve housing, in whose first housing part 8 and electromagnet 12 is disposed. The electromagnet 12 has a cup-shaped magnet housing 14, the bottom is penetrated by a coaxial, hollow-cylindrical magnet core 15 that is surrounded by a cylindrical exciter coil 16, which in turn is disposed on a coil carrier 17.

Figure 3:
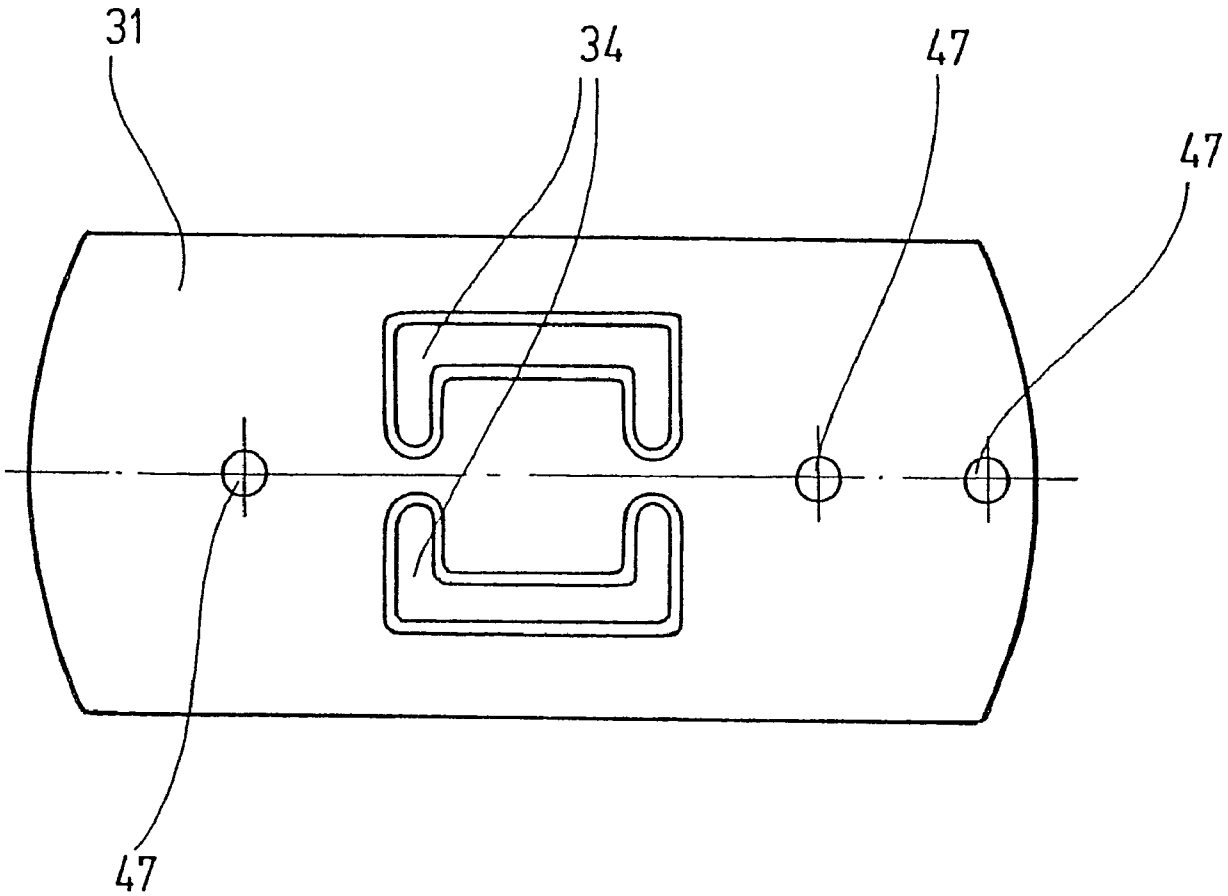
FIG. 3 is an elevation view of a valve seat body.

On its top, the magnet housing 14 is closed by a bracketlike valve seat body 31. The valve seat body 31 forms the reverse-action yoke of the electromagnet 12. The valve seat body 31 thus covers the magnet housing and is secured to the magnet housing by means of at least two fitting holes 47, shown in FIG. 3. A valve member 36 made of magnetic material at the same time forms the armature of the electromagnet 12. The valve member 36 is urged by a valve closing spring 43 in the valve closing direction, in the direction of an outflow neck 10, which is braced on one end on the valve member 36 and on the other end on a tubular end of the magnet core 15. On its side toward the valve seat body 31, the valve member has a sealing element of elastic material, such as elastomer. The sealing element 42 also lines the inside of the through opening 38 and protrudes somewhat past a side of the valve member 36 remote from the two valve openings 34 in the valve seat body 31.

In the currentless state of the electromagnet 12, the valve closing spring 43 presses the valve member 36, along with the sealing element 42, onto the valve seat body 31 and thus closes the valve opening 34. In the state in which current is supplied to the electromagnet 12, the valve member 36 is pressed, with its sealing element protruding out of the through opening 38, toward the end of the magnet core 15, which forms a stop for the reciprocating motion of the valve member 36. The stop can be embodied for instance by adjusting a thread, disposed on the magnet core 15, that engages a corresponding, complimentary thread provided on the magnet housing 14.

As seen from FIG. 1 and FIG. 2, a protective screen 70 is disposed on the side of the first housing part 8 toward the inflow neck 13 and covers the inflow-side end face of the first housing part 8. As a result of this protective screen, carbon particles, for instance, from the activated charcoal filter are prevented from reaching the interior of the first housing part and damaging the valve. Embodying the protective screen 70 with a large area is especially advantageous, because there is practically no restriction in the performance of the valve in terms of the flow through it.

The protective screen 70 can be secured to the first housing part 8 by a welded connection, for instance, or some other permanent connection, or the screen can be secured separably to the housing. This latter option is highly advantageous, especially with a view to replacing the protective screen 70, or a filter that is provided instead of the protective screen 70.

The second housing part 9, on which the inflow neck 13 is embodied, is secured to the first housing part 8 by a detent connection 80. A sealing element 82, for instance an O-ring seal, is disposed between the second housing part 9 and the first housing part 8.

Along with the clip connection 80, a bayonet connection is for instance conceivable as well, which enables easy opening of the housing, for instance for the sake of replacing the protective screen 70.

The two-part embodiment of the housing furthermore has great advantages, in particular with regard to the capability of producing the valve 1. For instance, the first housing part 8 can be finished first, together with the electromagnetically actuatable valve. Only then is the second housing part 9 including the inflow neck 13 secured to the first housing part 8, in a way adapted to a given installation situation. Particularly in automated production, this considerably simplifies the delivery of the individual components, shipping of the valves, and so forth. Type-specific differences, such as holders, connectors and the like, are provided on the second housing part 9 and do not have to be produced until the conclusion of the valve manufacture, by securing the second housing part 9 to the first housing part 8.

The outflow neck 10 has a convergent part 56 and divergent part 57 and thus forms a Laval nozzle, which from a first entrance cross section 60 narrows downstream in the vicinity of the valve seat body 31 to a narrowest cross section 61, and from this narrowest cross section 61, the neck widens again to an end cross section 62 on the downstream end. It is provided that the entrance cross section 60 is at least as large as or larger than the end cross section 62. The entrance cross section is preferably from 1.1 to 2 times larger than the end cross section 62. The narrowest cross section 61 is preferably embodied as 2 to 4 times smaller than the entrance cross section 60. The length of the Laval nozzle measured between the entrance cross section 60 and the end cross section 62 is for instance 3 to 5 times longer than a diameter at the entrance cross section 60. It is provided that the side of the valve seat body 31 that is opposite the entrance cross section 60 is spaced apart from the entrance side of the outflow neck 10 in the direction of the longitudinal axis 2 of the valve such that, between the entrance side of the outflow neck 10 and a sealing ring 51, which seals off an outer annular chamber between the valve seat body 31 and the annular housing part on which the outflow neck 10 is formed has a lateral length perpendicular to the longitudinal axis 2 of the valve that is at least as large as the diameter of the entrance cross section 60, and the valve openings 34 discharge into it.

The annular gap geometry 34 of this valve is selected such that the valve can also be used in a tank venting system of a direct gasoline injection internal combustion engine. In such an engine, to achieve constant accuracy of the minimum quantities, a higher maximum quantity is required. This is made possible by adapting the annular gap geometry of the valve seat body 31.

The foregoing relates to a preferred exemplary embodiment of the invention, it being understood that other variants and embodiments thereof are possible within the spirit and scope of the invention, the latter being defined by the appended claims.

What is claimed is:

1. A valve for introduction of metered fuel, volatilized from a fuel tank of an internal combustion engine into the engine, comprising a valve housing which has an inflow neck (13) for connection to a fuel tank or to an absorption filter downstream of the tank for the volatilized fuel, an outflow neck (10) for connection to the engine, a valve member accommodated between the inflow neck and the outflow neck in the interior of the valve housing, the valve member is actuatable by an electromagnet that has a magnet core, and which cooperates with a valve seat embodied on a valve seat body, the valve housing includes a first housing part (8), which includes an interior part that is closed on an inflow side by a protective screen (70), the electromagnet (12), the valve member (36) and the valve seat body (31) are disposed in the interior part of the first housing part (8) which includes the outflow neck (10), a second housing part (9), on which the inflow neck (13) is disposed, and said second housing part (9) is secured to the first housing part (8).

2. The valve according to claim 1, in which the two housing parts (8, 9) are separably joined together.

3. The valve according to claim 2, in which the connection is a bayonet connection.

4. The valve according to claim 3, in which the protective screen (70) is inseparably connected to the first housing part (8).

5. The valve according to claim 3, in which the protective screen (70) is separably secured to the first housing part (8).

6. The valve according to claim 2, in which the connection is a detent connection.

7. The valve according to claim 6, in which the protective screen (70) is inseparably connected to the first housing part (8).

8. The valve according to claim 6, in which the protective screen (70) is separably secured to the first housing part (8).

9. The valve according to claim 2, in which the protective screen (70) is inseparably connected to the first housing part (8).

10. The valve according to claim 2, in which the protective screen (70) is separably secured to the first housing part (8).

11. The valve according to claim 1, in which the two housing parts are inseparably joined together.

12. The valve according to claim 11, in which the connection is a detent connection.

13. The valve according to claim 11, in which the protective screen (70) is inseparably connected to the first housing part (8).

14. The valve according to claim 11, in which the protective screen (70) is separably secured to the first housing part (8).

15. The valve according to claim 1, in which the protective screen (70) is inseparably connected to the first housing part (8).

16. The valve according to claim 1, in which the protective screen (70) is separably secured to the first housing part (8).

* * * * *